US005802441A

United States Patent [19]

Okada

[11] Patent Number: 5,802,441

[45] Date of Patent: Sep. 1, 1998

[54] TONER CARTRIDGE WITH REMOVABLE SEALING FILM

[75] Inventor: Mitsuharu Okada, Osaka, Japan

[73] Assignee: Mita Industrial Co., Ltd., Osaka, Japan

[21] Appl. No.: 755,080

[22] Filed: Nov. 22, 1996

[30] Foreign Application Priority Data

Nov. 29, 1995 [JP] Japan ..... 7-310866

[51] Int. Cl.[6] ..... G03G 15/08

[52] U.S. Cl. ..... 399/262; 399/120; 222/541.9; 222/DIG. 1

[58] Field of Search ..... 399/258, 262, 399/260, 120; 222/153.07, 541.9, DIG. 1

[56] References Cited

U.S. PATENT DOCUMENTS 5,030,998 7/1991 Shibata et al. .
5,142,335 8/1992 Sakata et al. .
5,185,631 2/1993 Shibata .
5,621,507 4/1997 Nishimura et al. ..... 399/111
5,666,586 9/1997 Nishimura et al. ..... 399/13

*Primary Examiner*—R. L. Moses
*Attorney, Agent, or Firm*—Shinjyu An Intellectual Property Firm

[57] ABSTRACT

A toner cartridge is disclosed which includes a case having two toner discharge openings through the surface connected to a toner hopper, two sealing films, and a reeling shaft. The sealing films are removably adhered to the portion adjacent to the toner discharge openings, and seal the toner discharge opening. The reeling shaft is rotatably supported by the case, and allows the plurality of sealing films to be removed from the toner discharge openings during toner cartridge installation by reeling the sealing films around the reeling shaft. At least one of the plurality of sealing films is longer than the others, and is attached to the reeling shaft in a direction opposite that of the others. This arrangement allows the timing of removal of the sealing films to be shifted, thereby reducing the amount of torque required for their removal.

9 Claims, 5 Drawing Sheets

REELING TORQUE NEEDED TO REMOVE SEALING FILM 28

REELING TORQUE NEEDED TO REMOVE SEALING FILM 29

REELING TORQUE NEEDED TO REMOVE SEALING FILMS 28 AND 29

TONER CARTRIDGE WITH REMOVABLE SEALING FILM

BACKGROUND OF THE INVENTION

A. Field of the Invention

The present invention relates to a toner cartridge. More particularly, the present invention relates to a toner cartridge connectable to a toner hopper for supplying toner to a developing device in an image forming apparatus.

B. Description of the Related Art

In an image forming apparatus such as a copying machine, an image read from a original document by an exposure unit, and an electrostatic charge corresponding to the image is formed on a photosensitive drum. A developing device for forming a toner image on the electrostatically charged photosensitive drum is disposed adjacent thereto.

A toner hopper for supplying toner is provided in the developing device. A toner cartridge is detachably connected to the toner hopper, and toner is replenished by replacing this cartridge.

The toner cartridge is composed of a rectangular case having a plurality of toner discharge openings in the portion connected to the toner hopper. Toner is stored inside the case, and a sheet of sealing film is adhered to each of the plurality of toner discharge openings during manufacture. Each sealing film sheet extends across the width of the toner discharge openings, and is then folded back across itself. One end of each sealing film sheet is attached to a reeling shaft supported on the case, and each sheet may be peeled from the toner discharge openings by rotating the reeling shaft. The reeling shaft is usually rotated by a motor disposed inside the copying machine after the toner cartridge has been installed into the copying machine. Once the sealing film sheets are removed, the toner inside the toner cartridge flows into the toner hopper.

However, one problem with these types of toner cartridges is that it is often necessary to apply a high amount of torque to the reeling shaft in order to remove the sealing film sheets, thus requiring a strong motor and a strong reeling shaft. The addition of these features increases the cost of the copying machine and the toner cartridge. In order to reduce the amount of torque needed (and thereby reduce costs), it has been proposed to replace the normally rectangular-shaped toner discharge opening with an octagonal one. A toner discharge opening with an octagonal shape is smaller than the rectangular one, however the octagonal shape of the opening reduces amount of reeling torque needed at the beginning and end of the sealing film sheet removal process.

In the conventional structure described above, however, the amount of torque necessary is still undesirably high when there are a plurality of sealing film sheets to be peeled off of a plurality of toner discharge openings. This is due to the fact that the sheets are all attached to the reeling shaft in the same relative position and are all peeled away from the openings at the same time. The amount of torque necessary at the beginning and end of the sealing film sheet removal process is thus multiplied.

SUMMARY OF THE INVENTION

It is therefore an object of the present invention to reduce the amount of reeling torque needed to remove a plurality of sealing film sheets from a plurality of toner discharge openings in a toner cartridge.

In one aspect of the present invention, a toner cartridge includes a case having a plurality of toner discharge openings through a portion of the case, a reeling shaft which is rotatably supported by the case, and a plurality of sealing films. A first portion of each of the sealing films extend across each of the toner discharge openings and are removably adhered to a portion of the case surrounding said toner discharge openings. A second portion of each of the sealing films is folded back across the first portion and the toner discharge openings, and a third portion is attached to and extended around a circumferential portion of the reeling shaft. The third portion of at least one of the sealing films is attached to and extended around the reeling shaft in a circumferential direction opposite that of the other of the sealing films.

Preferably, a length of the sealing film attached to the reeling shaft in a circumferential direction opposite that of other sealing films is longer than a length of the other of the sealing films, and a difference in length of the sealing films is greater than or equal to half of a circumference of the reeling shaft but less than or equal to an entire circumference of the reeling shaft.

The plurality of sealing films are preferably composed of an air-permeable synthetic resin.

In another aspect of the present invention, a toner cartridge includes a case having a plurality of toner discharge openings through a portion of the case. The toner cartridge also includes a reeling shaft which is rotatably supported by the case. The toner cartridge also includes a first sealing film and a second sealing film, a first portion of each of the first and second sealing films extends across a corresponding one of the toner discharge openings and is removably adhered to a portion of the case surrounding the toner discharge openings. Further, the first and second sealing films are connected to the reeling shaft such that in response to rotation of the reeling shaft, the first sealing film is at least partially removed from a corresponding one of the toner discharge openings before the second sealing film begins being removed from a corresponding one of the toner discharge openings.

Preferably, each of the first and second sealing films is formed with a second portion that is folded back across the first portion and the toner discharge openings, and a third portion attached to and extended around a circumferential portion of the reeling shaft. As well, the third portion of at least one of the first and second sealing films is attached to and extended around the reeling shaft in a circumferential direction opposite that of the other of the first and second sealing films.

Preferably, a length of the third portion of one of the first and second sealing films attached to the reeling shaft is longer than a length of the other of the first and second sealing films, and a difference in the lengths of the third portions of the first and second sealing films is greater than or equal to half of a circumference of the reeling shaft but less than or equal to an entire circumference of the reeling shaft.

Preferably, the first and second sealing films are composed of an air-permeable synthetic resin.

In accordance with another aspect of the present invention, the toner cartridge includes a case having a plurality of toner discharge openings through a portion of the case, a film removing mechanism and a first sealing film and a second sealing film, a first portion of each of the first and second sealing films extending across a corresponding one of the toner discharge openings and removably adhered to a portion of the case surrounding the toner discharge openings. As well, the film removing mechanism and the first and second sealing films are configured such that removal of the first sealing film is sequentially offset from removal of the second film.

Preferably, the film removing mechanism includes a reeling shaft which is rotatably supported by the case and the first and second sealing films are connected to the reeling shaft such that in response to rotation of the reeling shaft the first sealing film is at least partially removed from a corresponding one of the toner discharge openings before the second sealing film begins being removed from a corresponding one of the toner discharge openings.

Preferably, each of the first and second sealing films is formed with a second portion that is folded back across the first portion and the toner discharge openings, and a third portion attached to and extended around a circumferential portion of the reeling shaft. Further, the third portion of at least one of the first and second sealing films is attached to and extended around the reeling shaft in a circumferential direction opposite that of the other of the first and second sealing films.

Preferably, a length of the third portion of one of the first and second sealing films attached to the reeling shaft is longer than a length of the other of the first and second sealing films, and a difference in the lengths of the third portions of the first and second sealing films is greater than or equal to half of a circumference of the reeling shaft but less than or equal to an entire circumference of the reeling shaft.

These and other objects, features, aspects and advantages of the present invention will become more fully apparent from the following detailed description of the present invention when taken in conjunction with the accompanying drawings, where like reference numerals denote corresponding parts throughout.

DETAILED DESCRIPTION OF THE PREFERRED EMBODIMENTS

Figure 1:
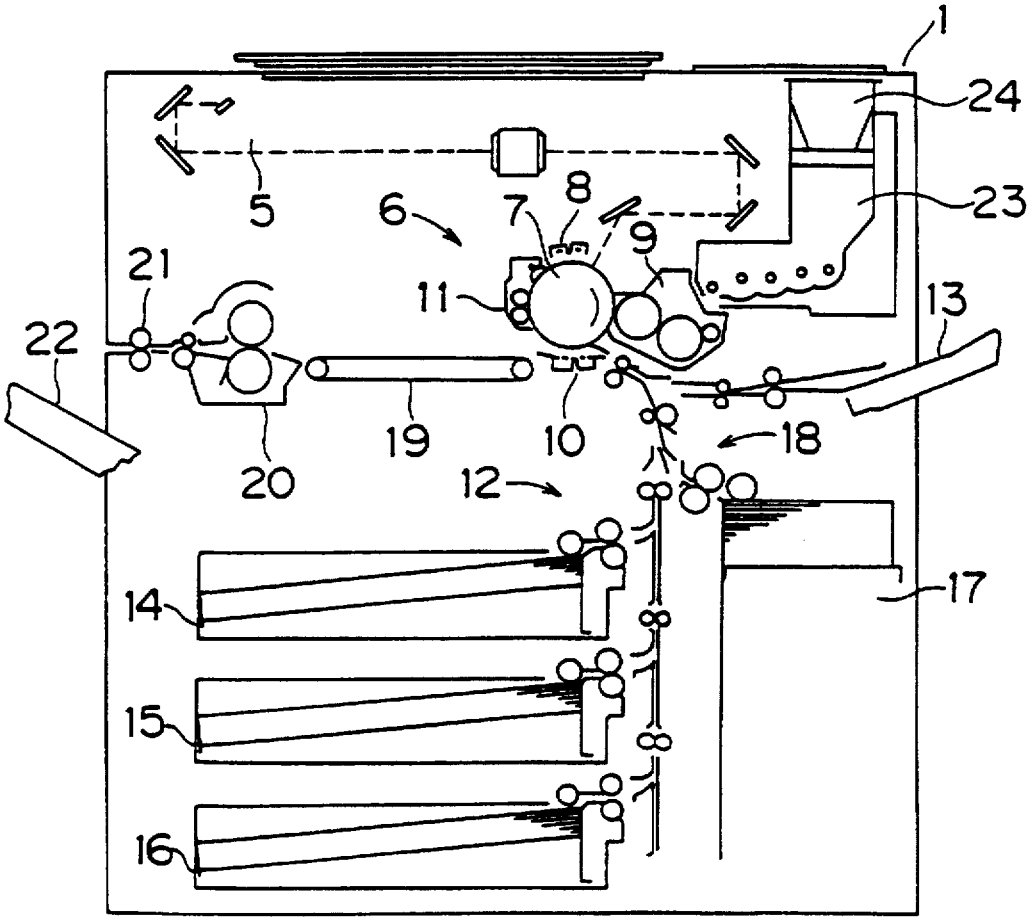
FIG. 1 is a cutaway view of a copying machine in which an embodiment of the present invention is employed.

A copying machine incorporating the present invention in accordance with one embodiment thereof is depicted in FIG. 1.

The upper portion of the copying machine 1 is, as shown in FIG. 1, provided with an optical exposure system 5 for reading an original document. The optical exposure system 5 includes a light source, mirrors, and a lens unit (not shown). Located in the central portion of the copying machine 1 is an image processor 6 for forming a toner image of the original document on a blank sheet of paper. The image processor 6 include a photosensitive drum 7, on the outer circumference of which an electrostatic latent image is formed. Surrounding the photosensitive drum 7, there is a main charger 8 for charging the photosensitive drum 7 with a predetermined level of electric charge, a developing device 9 for developing the electrostatic latent image, a transfer-separation device 10 for transferring a toner image to a sheet of paper and separating the sheet from the photosensitive drum 7, and a cleaning device 11 for removing excess toner form the photosensitive drum 7.

A paper supply unit 12 is located in the lower portion of the copying machine 1. The paper supply unit 12 includes a bypass table 13 located on the right side of the copying machine 1 in FIG. 1, three paper supply cassettes 14, 15 and 16 arranged perpendicular to the bottom portion of the copying machine 1, an oversized paper supply cassette 17 and a paper transporting device 18 for transporting the sheets stored in the bypass table 13 or the paper supply cassettes 14–17 to the image processor 6. Disposed in a portion of the sheet-transport stream forward of the image processor 6 are a paper transfer belt 19 for transferring the sheet toward the left side of the copying machine 1 in FIG. 1, a fixing device 20 for fusing and fixing toner images onto the sheet, a discharging roller 21 for discharging the sheet, and a sheet tray 22 for receiving the printed sheets.

The developing device 9 is provided with a toner hopper 23 for supplying toner to the image processor 6. A toner cartridge 24 is detachably connected to the toner hopper 23.

One embodiment of the toner cartridge 24 is shown in FIGS. 2–5. The toner cartridge 24 includes a generally rectangular case 25, and the lower portion of the case 25 is tapered towards the bottom. Toner discharge openings 26 and 27 are octagonal in shape and are provided in the bottom surface of the case 25. Sealing films 28 and 29 are attached over the openings 26 and 27, respectively (see FIG. 3), and are preferably composed of a air-permeable synthetic resin. By using air-permeable synthetic resins for the sealing films 28 and 29, it is possible to prevent a portion of one or more of the sealing films 28 and 29 from being prematurely detached from the case 25 due to an excessive increase in the atmospheric pressure differential between the inside and outside of the case 25.

The sealing films 28 and 29 each include a sealing portion 30 for sealing the toner discharge opening 26, 27, and peel-separation leaders 32 which are folded at folded portions 31, 34 and extend back across the sealing portions 30. The peel-separation leaders 32 are pulled to the right in the orientation of FIGS. 4 and 5 when the sealing films 28, 29 are removed, as is described in greater detail below.

Figure 3:
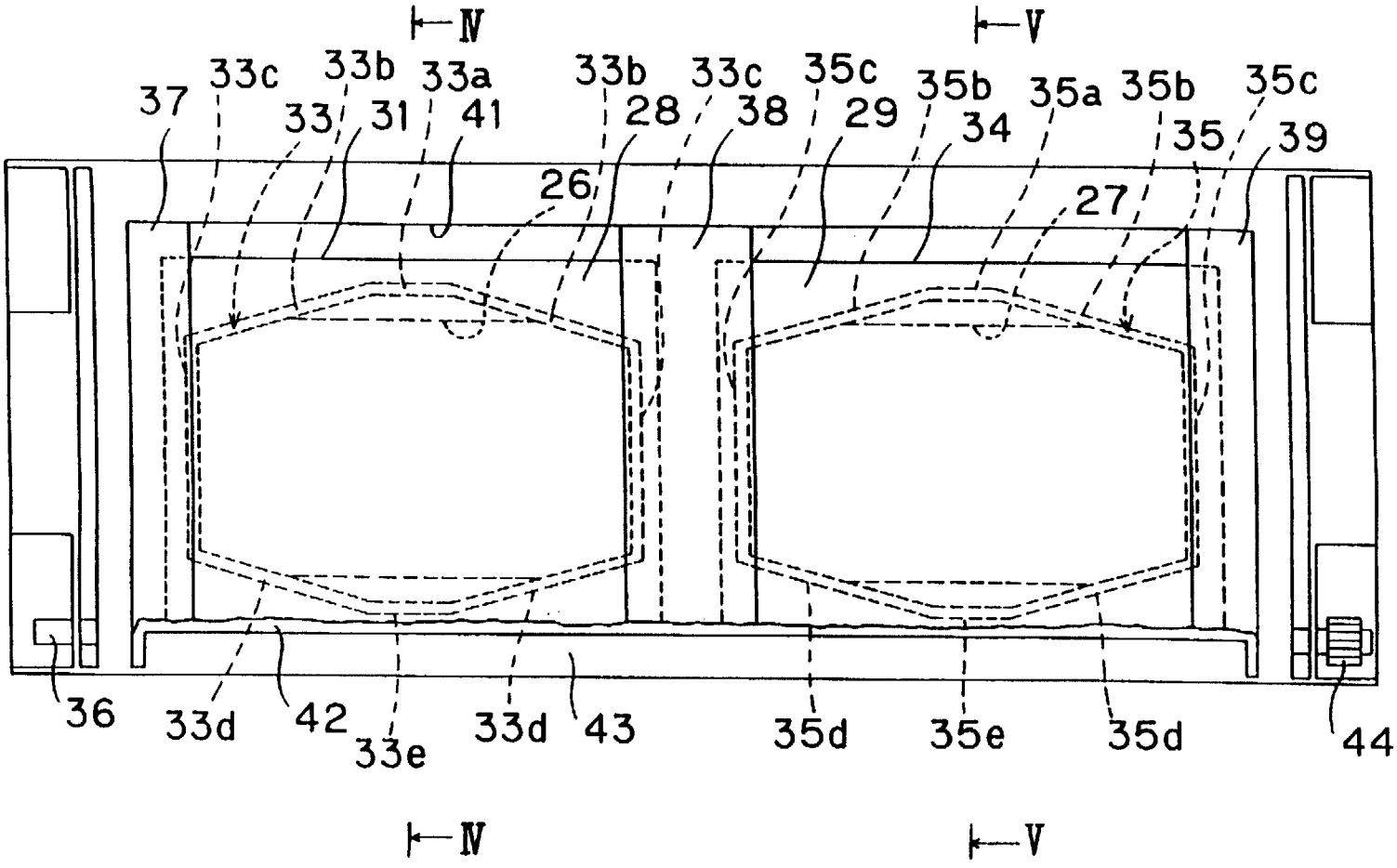
FIG. 3 is a fragmentary, bottom view of the toner cartridge depicted in FIG. 2, with portions of the toner cartridge such as an installation member 40, have been removed for clarity.

As shown in FIG. 3, the sealing portion 30 of sealing film 28 is thermally attached to portions adjacent to the toner discharge opening 26 by means of attachment portions 33*a*, 33*b*, 33*c*, 33*d* and 33*e*. The sealing portion 30 of sealing film 29 is thermally attached to a portion adjacent to the toner discharge opening 27 by means of attachment portions 35*a*, 35*b*, 35*c*, 35*d*, and 35*e*.

A reeling shaft 36 is axially supported by the case 25. One end of each of the sealing films 28 and 29 are secured to the reeling shaft 36, and when the reeling shaft 36 is rotated, the sealing films 28 and 29 are peeled away from the discharge openings 26 and 27.

Figure 4:
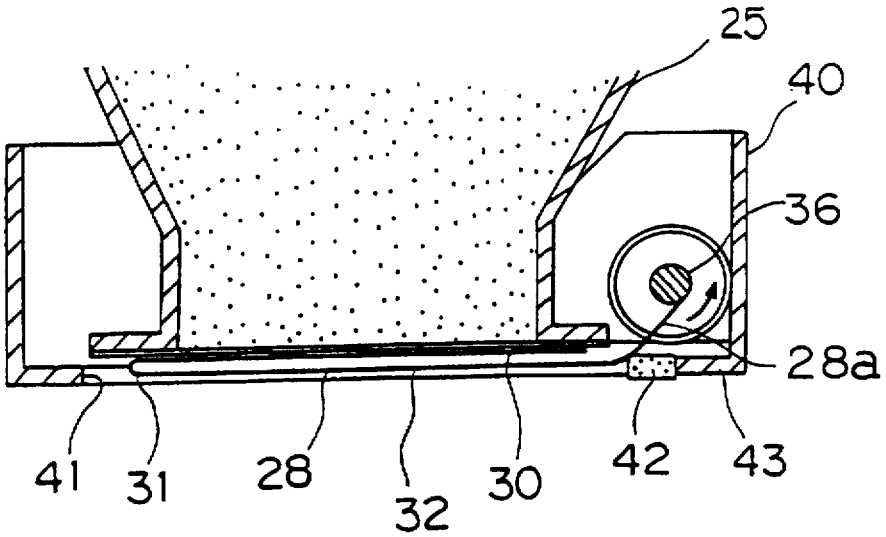
FIG. 4 is a fragmentary cross-sectional view of the toner cartridge depicted in FIG. 3, taken along the line IV—IV of FIG. 3 looking in the direction of the arrow.
Figure 5:
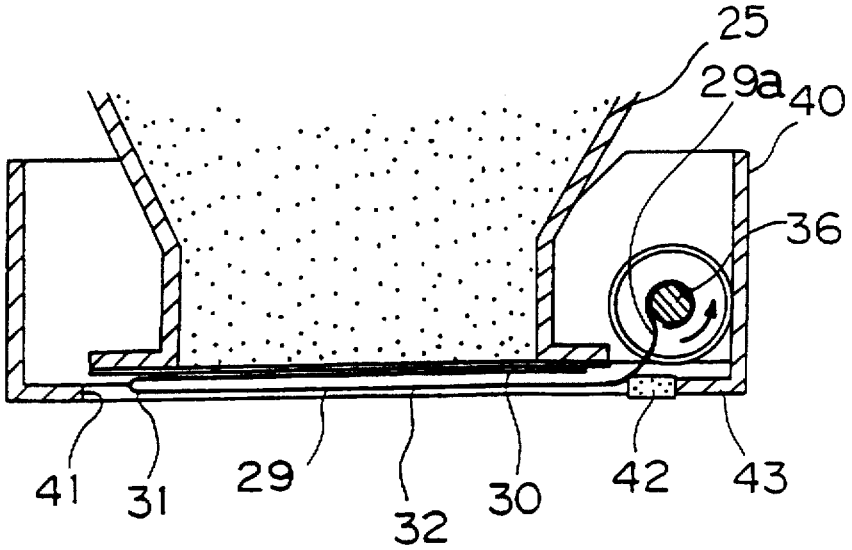
FIG. 5 is a fragmentary cross-sectional view of the toner cartridge depicted in FIG. 3, taken along the line V—V of FIG. 3 looking in the direction of the arrow.

As shown in FIG. 4, the sealing film 28 is formed with an end portion 28*a* which is attached to the reeling shaft 36. Further, the end portion 28*a* is wrapped partially around the reeling shaft 36 in a counterclockwise manner. As shown in FIG. 5, the sealing film 29 is formed with an end portion 29a. The end portion 29a is attached to the reeling shaft 36 but is wrapped around the reeling shaft 36 in a clockwise manner. The length of the end portion 29a of the sealing film 29 is longer than the end portion 28a of the sealing film 28, and in the embodiment depicted in FIGS. 4 and 5 the difference in length is approximately equal to the circumference of the reeling shaft 36. Arranging the end portions 28a and 29a of the sealing films 28 and 29 offsets the time when each sealing film is removed as each sealing film is wrapped about the reeling shaft 36. The offset configuration of the sealing films 28 and 29 due to the differing lengths of the end portions 28a and 29a allows a reduction in the amount of reeling torque required by shifting the timing of their removal from the discharge openings 26 and 27.

Preferably, the difference in length between the end portions 28a and 29a of the sealing film 28 and the sealing film 29 is equal to or greater than half the circumference of the reeling shaft 36, but less than or equal to the entire circumference of the reeling shaft 36. When this difference is less than half the circumference of the reeling shaft 36, it is difficult to provide a substantial difference in the timing of the removal of the sealing films 28 and 29. When this difference is greater than the circumference of the reeling shaft 36, the sealing film 29 may slacken and extend outward when reeling commences.

As shown in FIG. 3, cover members 37, 38 and 39 are disposed on the bottom surface of the case 25 so as to cover the sides of the sealing films 28 and 29. The cover members 37, 38 and 39 are preferably composed of polyethylene terephthalate, but may be composed of other synthetic resins. The portions of each cover members 37, 38 and 39 which cover the sealing films 28 and 29 are not connected to the case 25, so as not to obstruct the movement of the sealing films 28 and 29. Further, each of the cover members 37, 38 and 39 overlap with the sealing films 28 and 29 in order to prevent the invasion of toner into the gap between the overlapping portions.

Figure 2:
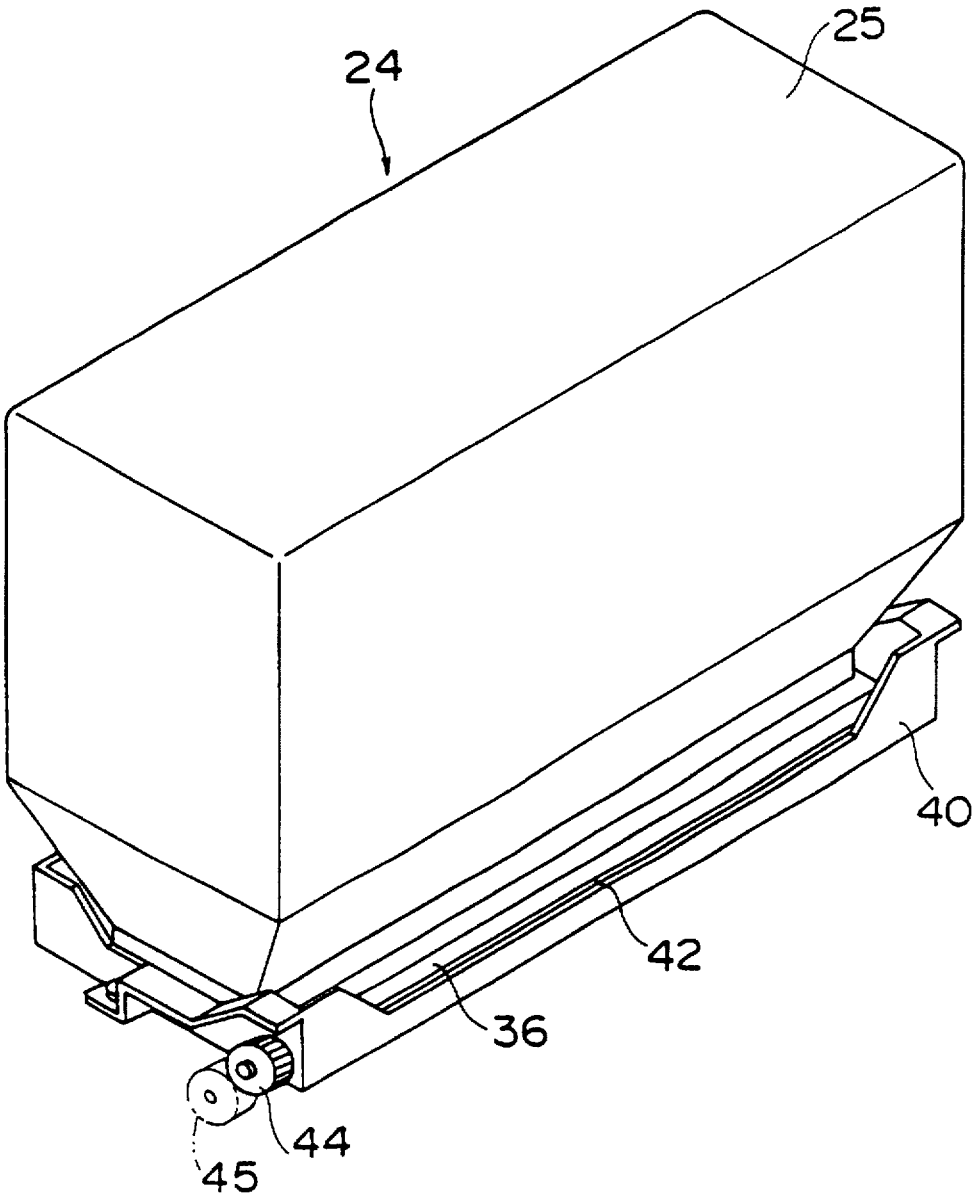
FIG. 2 is an oblique view of a toner cartridge according to one embodiment of the present invention.

FIGS. 2, 4 and 5 show an installation member 40 for fitting the toner cartridge 24 to the toner hopper 23 fixed to the bottom of the case 25. FIG. 3 shows openings 41, 41 provided in the bottom surface of the installation member 40, and allow the passage of toner discharged from the toner discharge openings 26 and 27 into the toner hopper 23. A film cleaning element 42 is disposed adjacent to the reeling shaft 36, and removes excess toner from the surface of the sealing films 28 and 29 by contacting the surface of thereof as they are being reeled in during toner cartridge installation. The film cleaning element 42 is composed of an elastic material such as a sponge, and is attached as a band along the flange portion 43 of the openings 41, 41.

A drive gear 44 is provided on an end of the reeling shaft 36. When the toner cartridge 23 is connected to the toner hopper 24, the drive gear 44 is coupled to a motor (not shown) and rotated by the motor. A handle can be provided on the reeling shaft 36, by which it can be manually rotated.

The installation of the toner cartridge 24 will now be described.

When the toner cartridge is empty and requires replacement, the toner cartridge is taken out of the toner hopper 23 and a new toner cartridge 24 is then inserted into the toner hopper 23. When this occurs, the drive gear 44 provided on the reeling shaft 36 is brought into engagement together with the gear 45 provided on the motor (shown in FIG. 2). When toner cartridge installation is detected by a sensor (not shown) in the copying machine, the motor rotates the gear 45 and causes the reeling shaft 36 to rotate in the direction indicated by the arrow in FIGS. 4 and 5.

When the reeling operation is started, the reeling shaft 36 rotates in a counterclockwise direction, as seen in FIGS. 4 and 5. As the reeling shaft 36 begins to rotate the end portion 28a becomes taut and the other end portion 29a remains in a slack state due to its initial condition, i.e. being wrapped clockwise about the reeling shaft 36. As the end portion 28a continues to be wrapped about the reeling shaft 36, the attachment portion 33a is peeled loose first, and the amount of the reeling torque applied to the reeling shaft 36 reaches a maximum at this time. After attachment portion 33a has been peeled away, attachment portions 33b are peeled away. The amount of reeling torque generated is less than that generated when attachment portion 33a was peeled away. After the attachment portions 33b have been peeled away, the attachment portions 33c are peeled away. At about this time in the wrapping process, the end portion 29a becomes taut around the reeling shaft 36 and removal of the attachment portion 35a on the sealing film 29 commences. In other words, the removal of the attachment portion 33c on the sealing film 28 and the removal of the attachment portion 35a of the sealing film 29 are carried out generally at the same time. Because the amount of the reeling torque required to remove the attachment portions 33c is minimal, a large amount of reeling torque is not required to peel away both the attachment portions 33c of the sealing film 28 and the attachment portion 35a of the sealing film 29 at the same time.

In the sealing film 28, the attachment portions 33d and 33e are peeled away in order. The amount of the reeling torque required to peel off the attachment portions 33d is almost the same as that required to peel off the attachment portions 33b, and the amount of the reeling torque required to peel off the attachment portion 33e is almost the same as that required to peel off the attachment portion 33a. After the sealing film 28 has been completely removed, the attachment portions 35d and 35e on the sealing film 29 are peeled off in order.

Figure 6A:
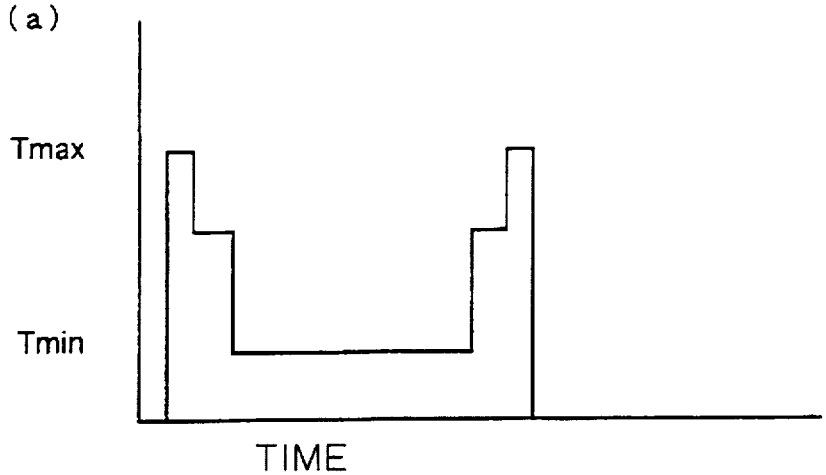
FIGS. 6(*a*), 6(*b*), and 6(*c*) are graphs showing the change in reeling torque as a function of time.
Figure 6B:
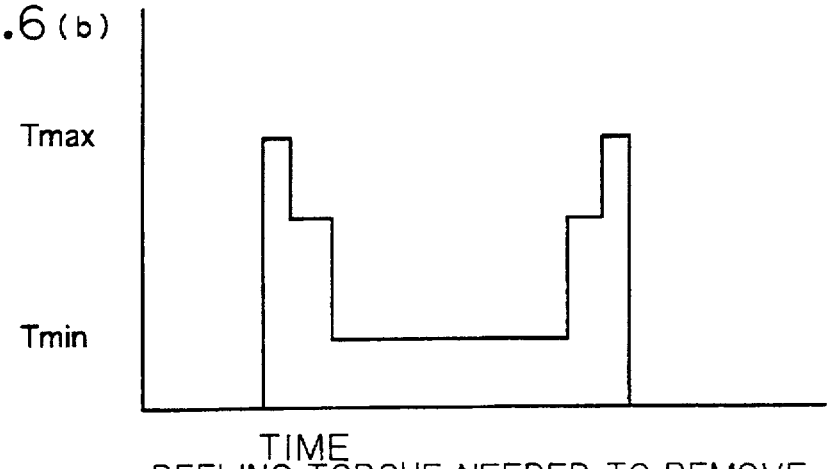
Figure 6C:
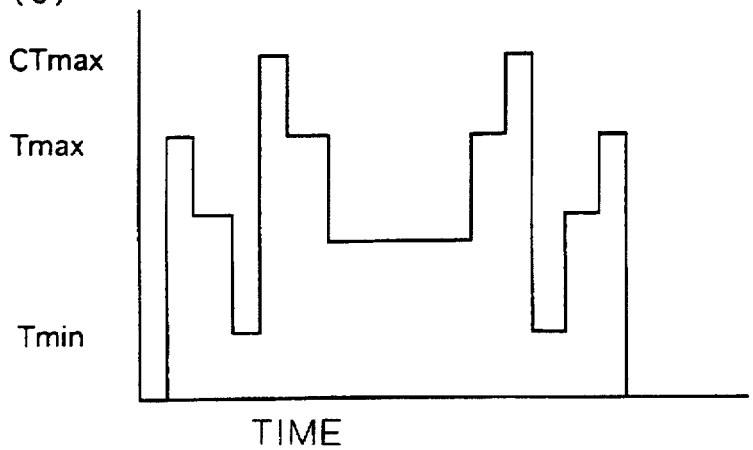

The changes in the amount of reeling torque required to remove the sealing film sheets 28 and 29 are shown in FIG. 6. FIG. 6(a) shows the change in reeling torque when the sealing film 28 alone is removed, FIG. 6(b) shows the change in reeling torque when the sealing film 29 alone is removed, and FIG. 6(c) shows the change in reeling torque when both the sealing films 28 and 29 are removed by shifting the timing of their removal with respect to each other as in the preferred embodiment of the present invention.

As shown in FIGS. 6(a) and 6(b), Tmax is the maximum amount of reeling torque needed to remove the sealing film from the case 25, and is produced when attachment portions 33a, 33e, and 35a and 35e are removed. Tmin is the minimum amount of reeling torque needed, and is produced when attachment portions 33c and 35c are removed. As described above, the sealing film 29 is placed around the reeling shaft 36 in such a way as to shift the timing of the removal of sealing film 28 and 29. This prevents the Tmax of sealing film 28 to coincide with the Tmax of sealing film 29. Thus, as shown in FIG. 6(c), the maximum amount of reeling torque needed in this embodiment will be CTmax, which is the sum of the Tmax of sealing sheet 29 and the Tmin of sealing sheet 28. If the timing of the sealing film removal was not shifted in this manner, CTmax would equal 2×Tmax. Thus, this invention allows the use of a motor that generates less torque, and a reeling shaft 36 which does not need to withstand high levels of torque, thereby allowing the cost of manufacturing copying machines and toner cartridges to be reduced.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A toner cartridge for use in a toner hopper for supplying toner to an image forming apparatus, the toner cartridge comprising:

a case having a plurality of toner discharge openings through a portion of said case;

a reeling shaft which is rotatably supported by said case; and a first sealing film and a second sealing film, a first portion of each of said first and second sealing films extending across each of said toner discharge openings and removably adhered to a portion of said case surrounding said toner discharge openings, a second portion of each of said sealing films folded back across said first portion and said toner discharge openings, and a third portion attached to and extended around a circumferential portion of said reeling shaft;

wherein said third portion of at least one of said first and second sealing films is attached to and extended around said reeling shaft in a circumferential direction opposite that of the other of said first and second sealing films.

2. The toner cartridge of claim 1, wherein:

a length of said third portion of one of said first and second sealing films attached to said reeling shaft is longer than a length of the other of said first and second sealing films, and a difference in the lengths of said third portions of said first and second sealing films is greater than or equal to half of a circumference of said reeling shaft but less than or equal to an entire circumference of said reeling shaft.

3. The toner cartridge of claim 1 wherein:

said first and second sealing films are composed of an air-permeable synthetic resin.

4. A toner cartridge for use in an image forming apparatus, the toner cartridge comprising:

a case having a plurality of toner discharge openings through a portion of said case;

a reeling shaft which is rotatably supported by said case;

a first sealing film and a second sealing film, a first portion of each of said first and second sealing films extending across a corresponding one of said toner discharge and second sealing film extending across a corresponding one of said toner discharge openings and removably adhered to a portion of said case surrounding said toner discharge openings;

said first and second sealing films are connected to said reeling shaft such that in response to rotation of said reeling shaft said first sealing film is at least partially removed from a corresponding one of said toner discharge openings before said second sealing film begins being removed from a corresponding one of said toner discharge openings; and wherein each of said first and second sealing films is formed with a second portion that is folded back across said first portion and said toner discharge openings, and a third portion attached to and extended around a circumferential portion of said reeling shaft;

wherein said third portion of at least one of said first and second sealing films is attached to and extended around said reeling shaft in a circumferential direction opposite that of the other of said first and second sealing films.

5. The toner cartridge of claim 4, wherein:

a length of said third portion of one said first and second sealing films attached to said reeling shaft is longer than a length of the other of said first and second sealing films, and a difference in the length of said third portion of said first and second sealing films is greater than or equal to half of a circumference of said reeling shaft but less than or equal to an entire circumference of said reeling shaft.

6. The toner cartridge of claim 4 wherein:

said first and second sealing films are composed of an air-permeable synthetic resin.

7. A toner cartridge for use in an image forming apparatus, the toner cartridge comprising:

a case having a plurality of toner discharge openings through a portion of said case;

a film removing mechanism;

a first sealing film and a second sealing film, a first portion of each of said first and second sealing films extending across a corresponding one of said toner discharge openings and removably adhered to a portion of said case surrounding said toner discharge opening;

said film removing mechanism and said first and second sealing films are configured such that removal of said first sealing film is sequentially offset from removal of said second film;

wherein said film removing mechanism comprises a reeling shaft which is rotatably supported by said case and said first and second sealing films are connected to said reeling shaft such that in response to rotation of said reeling shaft said first sealing film is at least partially removed from a corresponding one of said toner discharge openings before said second sealing film begins being removed from a corresponding one of said toner discharge openings;

wherein each of said first and second sealing films is formed with a second portion that is folded back across said first portion and said toner discharge openings, and a third portion attached to and extended around a circumferential portion of said reeling shaft; and wherein said third portion of at least one of said first and second sealing films is attached to and extended around said reeling shaft in a circumferential direction opposite that of the other of said first and second sealing films.

8. The toner cartridge of claim 7, wherein:

a length of said third portion of one of said first and second sealing films attached to said reeling shaft is longer than a length of the other of said first and second sealing films, and a difference in the lengths of said third portions of said first and second sealing films is greater than or equal to half of a circumference of said reeling shaft but less than or equal to an entire circumference of said reeling shaft.

9. The toner cartridge of claim 7, wherein:

said first and second sealing films are composed of an air-permeable synthetic resin.

* * * * *